United States Patent [19]

Fletcher et al.

[11] 4,025,891

[45] May 24, 1977

[54] METHOD FOR MAKING A HOT WIRE ANEMOMETER AND PRODUCT THEREOF

[76] Inventors: James C. Fletcher, Administrator of the National Aeronautics and Space Administration, with respect to an invention of; Volker Mikulla, am Buchenhain, Germany

[22] Filed: Nov. 10, 1975

[21] Appl. No.: 630,579

[52] U.S. Cl. ..... 338/28; 338/229

[51] Int. Cl.[2] ..... H01C 3/04

[58] Field of Search ..... 338/28, 229; 73/189, 73/204

[56] References Cited

UNITED STATES PATENTS 2,870,305 1/1959 Ling ..... 338/28 X

OTHER PUBLICATIONS

Series 900 Application Notes, "Flow Corporation Bulletin", No. 901, pp. 1–12, 9–12–67.

*Primary Examiner*—C. L. Albritton

*Attorney, Agent, or Firm*—Darrell G. Brekke; John R. Manning

[57] ABSTRACT

A hot wire anemometer probe that includes a ceramic body supporting two conductive rods therein in parallel spaced apart relation. The body has a narrow edge surface from which the rods protrude. A probe wire welded to the rods and extending along the edge surface and ceramic adhesive for securing the probe wire to the surface so that the probe wire is rigid. A method for fabricating the probe wherein the body is molded and precisely shaped by machining techniques before the probe wires are installed.

7 Claims, 7 Drawing Figures

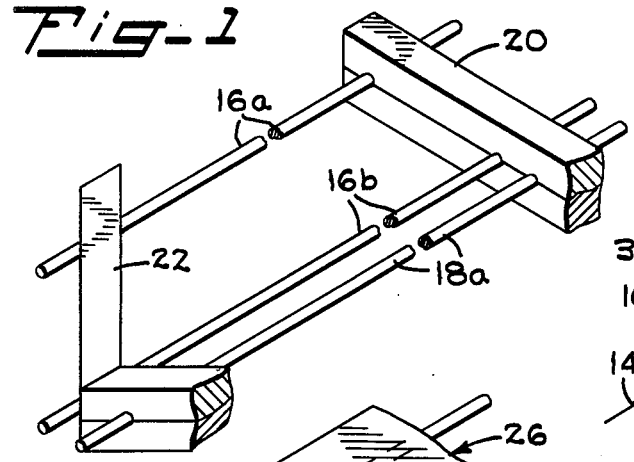
Fig-1
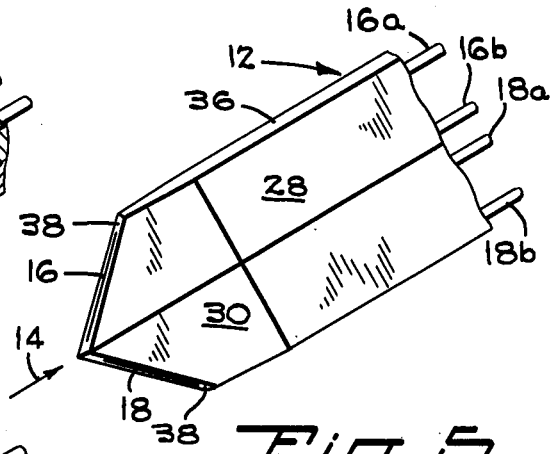
Fig-5
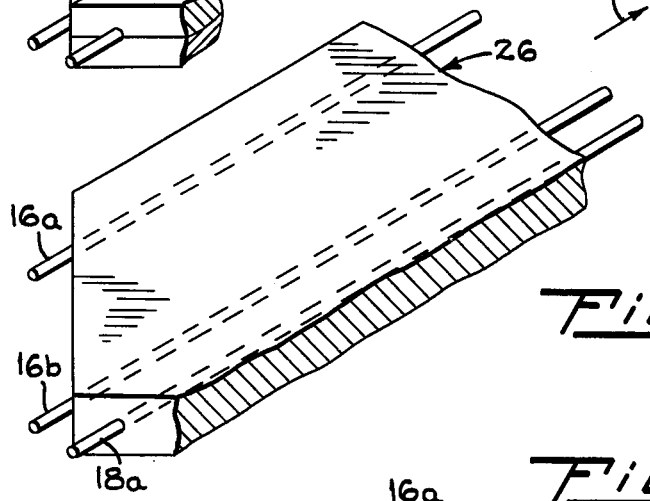
Fig-2
Fig-3
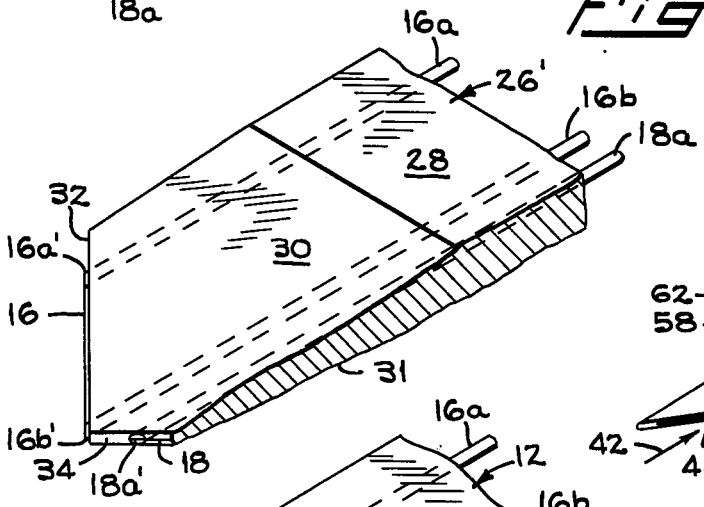
Fig-6
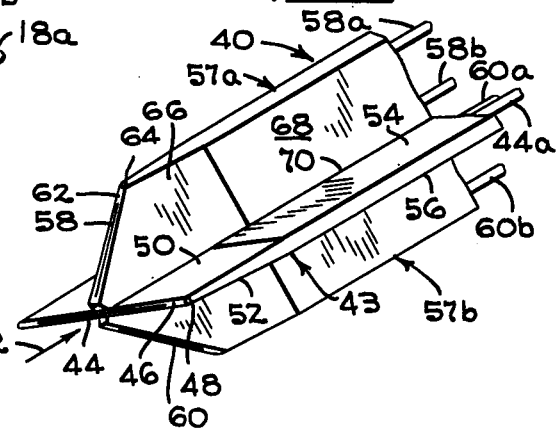
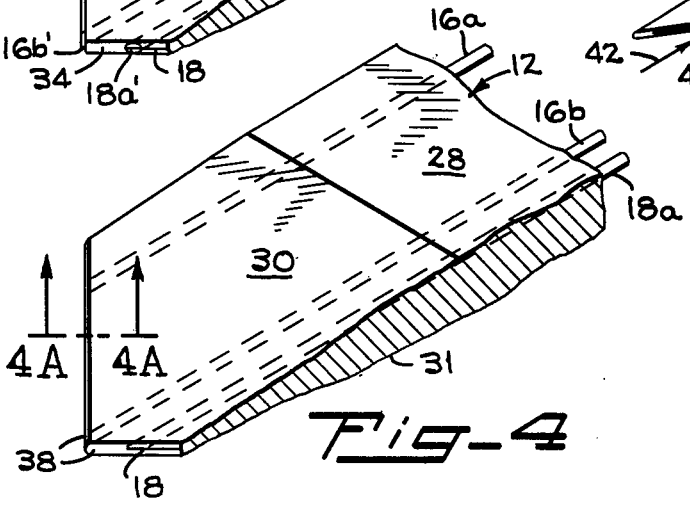
Fig-4
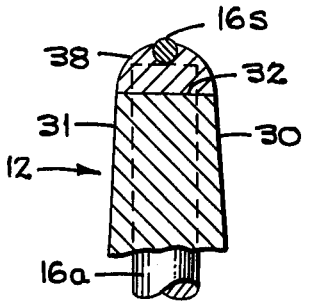
Fig-4A

METHOD FOR MAKING A HOT WIRE ANEMOMETER AND PRODUCT THEREOF

BACKGROUND OF THE INVENTION

1. Field of the Invention

This invention relates to hot wire aneomometers of the type employed to measure wind velocity turbulence and the like and more particularly to such anemometer and a method for constructing the same that affords improved high temperature operation.

2. Description of the Prior Art

U.S. Pat. No. 3,286,214 discloses a resistance thermometer structure formed in a rod shaped ceramic element in which the conductive portions of the device are sealed by employment of sintered glass-like material. All conductive parts of the patented device are enclosed.

U.S. Pat. No. 3,435,400 discloses a thermal probe constructed on a hypodermic needle or the like for measurement of fluid flow velocity, such as blood flow in animal and in man. The patented probe is formed on the tip of an oblique surface formed on the hypodermic needle; a thin homogeneous metallic membrane of platinum is coated on the oblique surface and the resistance across the membrane is measured to afford measurement of the fluid flow.

U.S. Pat. No. 3,553,827 discloses a thermo couple supported by ceramic spacers within a sheath of tantalum. All electric elements in the thermo couple are enclosed within the sheath.

Hot film sensors employing a thin film formed on a quartz rod or wedge are commercially available from Thermo-Systems, Inc. of St. Paul, Minn. Because the temperature sensitive material is in the form of a thin film, the temperature operating range of such probes is limited to about 400° C.

SUMMARY OF THE INVENTION

In measuring turbulence in hypersonic wind tunnels and the like, improved accuracy and stability can be achieved by employing hot wire anemometers operated at extremely high temperatures of up to 1,000° C or higher. Known anemometer probes that employ thin films are incapable of operating at such elevated temperatures. Anemometer probes employing unsupported wires suffer from wire slack strain gauging and wire vibration in the presence of high heat and high wind velocity, which at best produces inaccurate readouts and at worst causes destruction of the hot resistance probe wire. According to the present invention a probe structure is provided wherein the hot wire is supported throughout its length by a body that can be quickly and easily fabricated and that maintains its integrity even at such elevated temperatures.

An object of the present invention is to provide an efficient method for fabricating a hot wire anemometer having the aforementioned characteristics. This object is achieved according to the present invention by a method which includes the steps of supporting two or more conductor rods in parallel spaced apart relation, encapsulating the rods and the space between the rods with high temperature ceramic paste, such as an alumina based ceramic paste, curing the paste to form a rigid body, shaping the body to a desired streamlined shape, fixing, as by welding, a probe wire to protruding ends of the rods so that the probe wire lies along a thin edge surface of the body, applying ceramic paste to fix the wire to the edge surface throughout the extent thereof and so as to leave the front portion of the probe wire surface exposed to air flow, and then curing the adhesive paste. Although performance of each of the above steps is well within the purview of the skilled artisan, the steps when performed in the sequence provided by the invention produce a hot wire anemometer probe of superior characteristics and low cost.

Another object of the invention is to provide a probe constructed according to the method summarized above which probe has the following advantageous characteristics:

- Probes of virtually any shape or configuration can be fabricated accurately and with ease;
- Probes having plural probe wires can be provided in virtually any configuration; Anemometers having superior high temperature and high air velocity characteristics can be readily and inexpensively produced; and
- plural probes having virtually identical characteristics can be produced.

The foregoing together with other objects, features and advantages of the invention will be more apparent after referring to the following specification and the accompanying drawing.

BRIEF DESCRIPTION OF THE DRAWINGS

FIG. 1 is a fragmentary perspective view of a plurality of conductive rods supported during the initial steps in forming a probe according to the present invention.

FIG. 2 is a perspective view similar to FIG. 1 and showing the probe structure at an early stage in its fabrication.

FIG. 3 is a perspective view similar to FIG. 2 showing the probe at a subsequent stage of fabrication.

FIG. 4 is a view similar to FIG. 3 showing the probe at completion of the method according to the invention.

FIG. 4A is a cross section view at enlarged scale taken along line 4A—4A of FIG. 4.

FIG. 5 is a perspective view at reduced scale of a completed probe having two probe wires oriented obliquely and symmetrically of the probe axis.

FIG. 6 is a perspective view showing a three wire probe having two wires as in the embodiment of FIG. 5 and a third wire normal to said wires and to the probe axis.

DETAILED DESCRIPTION OF THE PREFERRED EMBODIMENT

Referring more particularly to the drawing and to FIG. 5 reference numeral 12 indicates a probe formed according to the present invention. The probe is adapted for placement in an airstream moving in a direction indicated by arrow 14 so that the air current flows over the surfaces of probe wires 16 and 18 mounted at the front end of the probe. The probe wires are connected to respective conductives rods **16*a* and 16*b*** and ~*a* and **18*b* which are terminated at a rear portion of the probe. Suitable test equipment of known form is connected to the conductive rod terminations which test equipment provides a current to heat probe wires 16 and 18 and provides facilities for measuring the change in the current in response to air flow therepast, which current change is indicative of wind velocity on path 14. The material employed in probe 12** will be described in more detail hereinbelow in connection with disclosure of the method employed to fabricate the probe.

Referring to FIG. 1 rigid jigs 20 and 22 are mounted in fixed relation to one another and support in spanning relationship therebetween the conductor rods that form a part of the probe, conductor rods 16*a*, 16*b* and 18*a* being shown in FIG. 1. Jigs 20 and 22 are configured in the approximate shape of the probe body and specifically jig 22 is formed of two perpendicular members that form oblique surfaces approximately symmetrical with longitudinal axis of the probe which axis is parallel to the direction of wind moving along path 14. The conductive rods are formed of stainless steel or like material that has suitable high temperature strength and electrical conductivity. In one probe designed according to the invention the conductor rods have a diameter of about 0.005 –0.008 inches.

Side walls (not shown) are placed at the respective ends of jigs 20 and 22 so as to form a cavity having a shape approximately that of the probe body. Thereafter a ceramic paste having a high proportion of alumina or like high temperature material, is poured into the cavity and cured, such as by heat treatment, until the material is hard. One suitable form of high temperature ceramic paste that is satisfactory is sold under the tradename Cerama-Dip 538 by Aremco Products, Incorporated, Ossining, N.Y. Such material is cured by air drying at ambient for about one hour and then by heat treating for about four hours at about 180° F. When cured the material can withstand temperatures up to about 3200° F.

When the ceramic paste has cured jigs 20 and 22 are removed so as to provide a probe body blank identified at 26 in FIG. 2. The probe body blank 26 is then shaped by grinding procedures or the like to produce a desired shape of rather precise dimensions. Because grinding procedures are well understood by those skilled in the art, a probe body of the desired configuration and dimensions can readily be achieved.

The ground probe body is identified in FIG. 3 by reference numeral 26'. The body includes mutually parallel top and bottom surfaces, the top surface being shown at 28 and being oriented for disposition parallel to the direction of wind movement. Toward the front of the probe body are upper and lower tapering surfaces 30 and 31, respectively. Surfaces 30 and 31 are symmetrical of the central axis of the probe body; the angle between the plane of the surfaces is a very small acute angle so as to form a steamlined structure that creates insignificant turbulence in the airstream in which it is placed. At the front end of the probe body toward which the tapering surfaces converge are front edge surfaces 32 and 34 which are symmetrical of the central axis of the probe body and disposed at a suitable angle, such as 45°, relative to the longitudinal axis. Edge surfaces 32 and 34 preferably have a thickness dimension, measured vertically as seen in the drawings, of about 0.005–0.0010 inches and tapering surfaces 30 and 31 diverge therefrom to flat surface 28 so as to form a streamlined configuration for placement in an airstream.

Also accomplished in the grinding procedure is the formation of the outer ends of the conductor rods with surfaces parallel to respective edge surfaces 32 and 34 and protruding from the edge surfaces by a slight amount, e.g. 0.001–0.003 inches. The protruding tip of conductor rod 16*a*, 16*b* and 18*a* are identified in FIG. 3 at 16*a'*, 16*b'*, and 18*a'*, respectively. Finally there is accomplished during the grinding step the formation of smooth side edges one of which is indicated at 36 in FIG. 5. When the grinding procedure is completed there is provided a smooth, streamlined, high strength and high temperature probe body. Because precision grinding procedures are well known, it is possible to produce the probe body to extremely accurate tolerances.

Next probe wires 16 and 18 are mounted by welding the probe wires to the protruding tips of the conductor rods. The probe wires are supported against edge surfaces 32 and 34 and against the protruding ends of the condutor rods and are spot welded to the protruding ends of the conductor rods to form a secure mechanical and electrical junction. In one probe designed according to the present invention, probe wires 16 and 18 are formed of wire composed of 90% platinum - 10% rhodium and having a diameter of 10 $\mu$ (1 $\mu$ = 1 micron = $1 \times 10^{-6}$meters). Wire of such dimension is extremely fragile and the invention provides for supporting the wire without adversely affecting the accuracy of measurement afforded by the probe.

A very thin layer 38 of ceramic adhesive is placed on edge surfaces 32 and 34; the ceramic adhesive is substantially coextensive with the surfaces and fills any interstices between the probe wire and the edge surfaces. A suitable ceramic adhesive that has been found useful and that is compatible with the above mentioned ceramic paste from which body blank 26 is formed is Ceramabond 503 marketed by Aremco Products, Inc. of Briarcliff Manor, N.Y. After the ceramic adhesive is applied, it is cured, such as by heat treating after which any of the material that extends over the front surface of probe wires 16 and 18 is scrapped off very carefully so that the front surface of the probe wire, indicated at 16*s* in FIG. 4A, is exposed to air flow along path 14 but the rear surface of the wire is encased and supported by the adhesive.

The completed probe as seen in FIG. 5 is now ready for installation in a wind tunnel and is oriented so that the longitudinal axis of the probe is parallel to the direction of wind movement indicated by path 14. The rearward ends of conductive rods 16*a*, 16*b*, 18*a* and 18*b* are electrically connected to conventional measuring equipment which both supplies a current to the probe wires and measures the change in current flow therethrough in response to temperature changes induced by the air stream moving thereover. It is conventional to connect the two wires to separate measuring circuits and to measure the fluctutaing output voltages simultaneously. Because it enables precise formation of the relative angles of edge surfaces 32 and 34, this mode of operation produces stable and accurate correlation measurements between longitudinal and lateral velocity fluctuations.

In reference to FIG. 6, there is a probe 40 that is constructed by the method of the invention and which provides three separate probe wires in the wind stream moving on a path indicated at 42. Prove body 40 includes a central body portion 43 that supports on the front edge surface thereof a probe wire 44 in a direction perpendicular to path 42. Probe wire 44 is supported as are probe wires 16 and 18, described hereinabove, in ceramic adhesive 46 which is bonded to a front edge surface 48. The front edge surface is formed by grinding a body blank with upper and lower tapering surfaces 50 and 52 which diverge rearwardly to mutually parallel upper and lower surfaces 54 and 56. Extending through the central body portion are conductor rods for supporting probe wire 44 and establishing electrical connection to the opposite ends thereof, one such conductor rod being indicated at 44*a*.

Probe 40 also includes two identical upper and lower portions 57*a* and 57*b* which when joined to the central body portion cooperate to support probe wires 58 and 60 with an airstream 42. The upper and lower probe body portions are formed symmetrically so that probe wires 58 and 60 are supported symmetrically of the longitudinal axis of the probe body which is supported in parallelism with path 42. Because the upper and lower probe body portions are identical only upper probe body portion 57*a* will be described in detail. Having reference to probe wire 58, it is encased in ceramic adhesive 62 on a front edge surface 64. Diverging rearward from edge surface 64 are tapering surfaces, one of which is seen at 66. At the rear extremity of tapering surface 66 is a flat surface 68 which is parallel to the longitudinal axis of the probe body. Electrical and mechanical connection with probe wire 58 is afforded by conductor rods 58*a* and 58*b* which extend to the rear portion of the probe body and afford electrical connection to the probe wire 58. There are corresponding probe wires 60*a* and 60*b* for establishing electrical connection to probe wire 60.

Upper probe body portion 57*a* is formed as has been described hereinabove, i.e. by first molding a ceramic paste around and between the probe wires 58*a* and 58*b* and then by grinding the body blank thus produced to a suitable shape. In so grinding the probe body blank, the inner surface 70 thereof is configured to match the contour of surfaces 50 and 54 of central probe body portion 43. Surface 70 is formed smooth so as to afford a good adhesive joint onto the surfaces 50 and 54 of the central probe body portion. The adhesive referred to hereinabove and exemplified in FIG. 6 at 62 is suitable for attaching the upper probe body portion to the central probe body portion. The lower probe body portion is adhesively joined to the central body portion in a like manner.

In operation the probe of FIG. 6 is installed in a wind tunnel or like environment with the longitudinal axis thereof parallel with wind path 42. Electrical connections are made between the rear ends of the conductive rods to suitable electrical test equipment. The three probe wire construction of FIG. 6 is particularly stable because probe wire 44, because it lies perpendicular to air path 42, can afford temperature compensation for the measuring circuitry to which the conductor rods are attached. Thus the velocity outputs, particularly in the embodiment of FIG. 6, accurately reflect the velocity of the air irrespective of the temperature thereof.

It will thus be seen that the present invention provides an improved probe construction and method for forming the same which can be carried out by employment of straightforward process steps. Because the probe is molded of ceramic paste very high in alumina content, the resulting probe is of extremely high strength and accuracy even in the presence of high temperatures. Moreover, because the final configuration of the probe is established by grinding, very accurate and streamlined configurations can be produced. Finally because the very delicate probe wires are supported and partially embraced or imbedded throughout their length, the probe of the invention produces accurate results even in the presence of high temperatures and high wind velocities.

Although several embodiments of the invention have been shown and described it will be obvious that other adaptations and modifications can be made without departing from the true spirit and scope of the invention.

What is claimed is:

1. A hot wire probe for placement in a path for moving fluid comprising a rigid, high temperature resistant, electrically insulative ceramic body, at least two electrically conductive rods embedded in said body, said body defining at least one narrow substantially flat edge surface, said conductive rods having ends protruding from said edge surface in spaced apart relation, a probe wire lying along said edge surface with the extremities of said probe wire welded respectively to said protruding rod ends, and ceramic means for adhesively joining said probe wire to said edge surface, said adhesively joining means encasing all but a portion of the probe wire surface remote from said edge surface.

2. A hot wire probe according to claim 1 wherein said conductive rods are substantially parallel to one another.

3. A hot wire probe according to claim 1 wherein said body defines upper and lower smooth flat surfaces that diverge respectively from opposite extremities of said edge surface at a very small acute angle so as to avoid creating turbulence in said fluid path.

4. A hot wire probe for placement in a path of moving fluid comprising a rigid, high temperature resistant, electrically insulative body, four conductive rods forming first and second spaced apart pairs of rods, said body defining first and second narrow substantially flat edge surfaces, the conductive rods in said first pair protruding from said first edge surface and the conductive rods of said second pair protruding from said second edge surface, said edge surface diverging symmetrically from a central point, first and second probe wires fixed in spanning relation of the conductive rods of respective pairs and lying along respective edge surfaces, means for adhesively joining each probe wire to its respective edge surface, said adhesively joining means being confined to expose the surface of each said probe wire remote from its respective edge surface.

5. A three wire probe for placement in a fluid moving along a path comprising a central body portion formed of rigid high temperature resistant electrically insulative material, said body defining a narrow edge surface normal to the path and having side surfaces diverging from respective extremities of said edge surface at a very small acute angle, a first pair of conductive rods imbedded in said body and having ends terminating in spaced apart relation in said edge surface, a probe wire having ends fixed to respective said rods and lying along said edge surface, upper and lower body portions joining said central body portion and extending normal to said diverging surfaces, said upper and lower body portions defining edge surfaces having inner ends adjacent the midpoint of said first edge surface and outer ends diverging rearwardly therefrom, second and third pairs of conductive rods imbedded in respective said upper and lower body portions and terminating in respective said edge surfaces, second and third probe wires fixed to the protruding ends of respective said rod pairs and lying along respective said edge surfaces, and means for adhesively joining said probe wires to their respective edge surfaces, said adhesive means being confined to expose the surfaces of said probe wire remote from respective said edge surfaces.

6. A three wire probe according to claim 5 wherein said upper and lower edge surfaces diverge symmetrically of the edge surface of said central body portion.

7. A hot wire probe for placement in a path of moving fluid comprising a rigid, high temperature resistant, electrically insulative ceramic body, four electrically conductive rods forming first and second spaced apart pairs of rods, said body defining first and second narrow substantially flat edge surfaces, the conductive rods in said first protruding from said first edge surface and the conductive rods of said second pair protruding from said second edge surface, said edge surfaces diverging symmetrically from a central point, a first probe wire having its ends welded respectively to the protruding ends of said first pair of conductive rods, a second probe wire having its ends welded respectively to the protruding ends of said second pair of conductive rods, ceramic means for adhesively joining each probe wire to its respective edge surface, said ceramic means securely encasing all but a portion of the surface of each probe wire, in each case said portion being the surface remote from said edge surface.

* * * * *